United States Patent [19]

Maraman

[11] Patent Number: 4,856,729

[45] Date of Patent: Aug. 15, 1989

[54] HOLD AND UNWIND REEL FOR COILED MATERIAL

[75] Inventor: Ned D. Maraman, Savannah, Ga.

[73] Assignee: Patents Unlimited, Inc., Savannah, Ga.

[21] Appl. No.: 152,325

[22] Filed: Feb. 4, 1988

[51] Int. Cl.[4] ..... B65H 49/00

[52] U.S. Cl. ..... 242/129

[58] Field of Search ..... 242/129, 128, 129.5, 242/130.1, 115

[56] References Cited

U.S. PATENT DOCUMENTS

| | | | |
|---|---|---|---|
| 2,562,650 | 7/1951 | Trunkhill | 242/129 |
| 2,630,980 | 3/1953 | Weaver | 242/129 |
| 2,847,172 | 8/1958 | Salkield | 242/129 |
| 3,017,136 | 1/1962 | Noffke | 242/129 |
| 3,729,092 | 4/1973 | Marcell | 242/129 X |
| 3,837,597 | 9/1974 | Bourhenne | 242/129 |
| 3,974,980 | 8/1976 | Marcell | 242/129 X |
| 4,167,255 | 9/1979 | Benson | 242/129 |

*Primary Examiner*—Stanley N. Gilreath

*Attorney, Agent, or Firm*—Cushman, Darby & Cushman

[57] ABSTRACT

A device to hold and permit coiled wire to be smoothly unwound without inserting kinks or knots into the unwound lengths. The device includes a conically shaped coil holding assembly which includes a plurality of flexible coil support members that directly support the coiled wire.

11 Claims, 3 Drawing Sheets

HOLD AND UNWIND REEL FOR COILED MATERIAL

BACKGROUND OF THE INVENTION

1. Field of the Invention

The invention relates to a device for holding coiled material, such as wire, which permits the uncoiling thereof. The device can be attached to studs or roof trusses and allows coiled material to be removed without twisting and kinking.

2. Description of the Prior Art

A suspended reel for allowing coiled material, such as electrical wire, to be unwound is described in Marcell U.S. Pat. No. 3,729,092. According to this patent a coil of wire is supported on a flat base plate. One end of each of a plurality of lines are secured to the base plate at spaced apart points symmetrically arranged around the center of the plate and about halfway between the center and the outer periphery thereof. The other end of the lines converge above the plate after passing through the center of the coiled material. They are secured together and connected to a swivel device which is clipped to a hook adapted to be hung from a rafter, a pipe or the like. The support for coiled wire is directly provided by the base plate, itself formed from stiff material. Thus, the device is heavy and momentum due to rotation not only of the coiled material and the heavy base will cause continued rotation of the device once pull on the wire to unwind the coil is stopped. This continued rotation will undesirably allow wire to unwind.

A later patent to Marcell, U.S. Pat. No. 3,974,980, also describes an uncoiling device somewhat similar to that described in the above '092 Marcell patent but permits the dispensing of wire from coils still retained in a carton. Here both the carton and coil rest directly on a base plate. The device includes rotatable means for paying out the wire from inside the center of the carton and a brake device built into the swivel connection to retard rotation. This device will also revolve to allow wire to be uncoiled when tangential pull is exerted on the wire and accommodates varying sizes of inner coil diameters by changing the base plate connection point for the lines used to suspend the base plate. Accordingly, such a wire dispensing device suffers the same drawbacks as the previous device and needs changeover time to accommodate different coil diameters.

Benson, U.S. Pat. No. 4,167,255 discloses a stud grip or clamp bracket which is removably mountable on studs for supporting a wire dispensing reel. The bracket includes a first arm having a generally channel shaped end which extends around the rear of a stud and a second arm pivotally connected intermediate its two ends to the other end of the first arm. The end of the second arm closest the stud engages the opposite side of the stud from that engaged by the channel shaped end on the first arm so that the stud is clamped therebetween. A coiled reel may be rotatably suspended from the other end of the pivot arm so that wire may be paid out for installation in a home or building. Here again, the coil rests directly on a base plate which is supported from the bracket by a plurality of lines extending upwardly from the plate through the center of the coil to a swivel.

Salkield, U.S. Pat. No. 2,847,172, discloses a floor mounted coiled wire dispenser comprised of a weighted base member provided with an upstanding support rod. A bottom ring or frame is attached to the top of that rod by a plurality of chains with one end of each chain being attached to the top of the rod and the other end to the ring at spaced apart positions about the ring. Salkield also discloses a brake device to prevent overriding when the worker stops paying out the coiled material from reel. The brake includes an L-shaped member attached to the base so that the bottom ring or frame can engage the vertical portion of the L-shaped member. By covering the upwardly extending vertical portion of the L-shaped member with a friction material, e.g. rubber, and by fixing it to the base plate at a distance slightly less than the radius of the bottom ring or frame, the ring or frame will normally contact the brake when wire is not being pulled. As wire is pulled the frame pivots away from the vertical support and will rotate. This requires the direction of pull be from a direction generally opposite the brake member. When pulling force stops, the vertical portion of the brake arm will again contact the frame so that the friction material will engage and slow or stop rotation of the frame.

Reference can also be made to Trunkhill, U.S. Pat. No. 2,562,650 and Noffke, U.S. Pat. 3,017,136 which show other types of electric wire dispensing reels. Other types of support members are shown in Hauser, U.S. Pat. No. 1,034,365, Martinsen, U.S. Pat. No. 1,597,095 and Pelavin, U.S. Pat. No. 3,907,118.

SUMMARY OF THE INVENTION

The improved device for holding and unwinding coiled material according to the present invention is characterized by the fact that the assembly which actually supports the coil is comprised of a generally conically shaped structure or mandrel. This mandrel structure is itself comprised of a plurality of separated flexible support members which extend upwardly from a bottom member, designed to hold and separate the bottom ends of the flexible support members apart. Each of the flexible supports extend upwardly and converge together at a swivel connector which is spaced from the bottom member by a rod positioned therebetween. This rod is designed to permit adjustment of the distance between the swivel and the bottom member and thereby allows adjustment of the degree of tension in the support members. Accordingly, this mandrel constitutes a self-sustaining structure that will support coils of different diameters directly on the flexible support members. This allows such coils to be supported in a balanced attitude. With the support assembly suitably mounted it will be able to rotate in a smooth, balanced manner when a tangentially applied pulling force is exerted on the wire. As long as this pulling force is applied unwinding of wire from the coil will continue. The support or reel assembly also includes a positive braking arrangement which employs the dispensed wire itself as part of the brake mechanism to brake further rotation when the tangential force is stopped.

One of the objects of the present invention is to provide a dispensing device having a simple structure and low weight.

Another object is to provide a dispenser which will receive and hold a coil of electric wire, conductor, cable, or the like regardless of the internal diameter of the coil and which will allow wire pulling forces to be applied in any direction. Elimination of the kinking and twisting of the cable as it is unwound is also an objective.

Still another object is to provide a wire dispenser which easily adapts to any inside diameter of wire rolls and which may be suspended from overhead rafters or studs and unreeled as desired without kinking, bending or abrading the wire as it is unwound.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various figures.

DETAILED DESCRIPTION OF THE EXEMPLARY EMBODIMENTS OF THE PRESENT INVENTION

Figure 1:
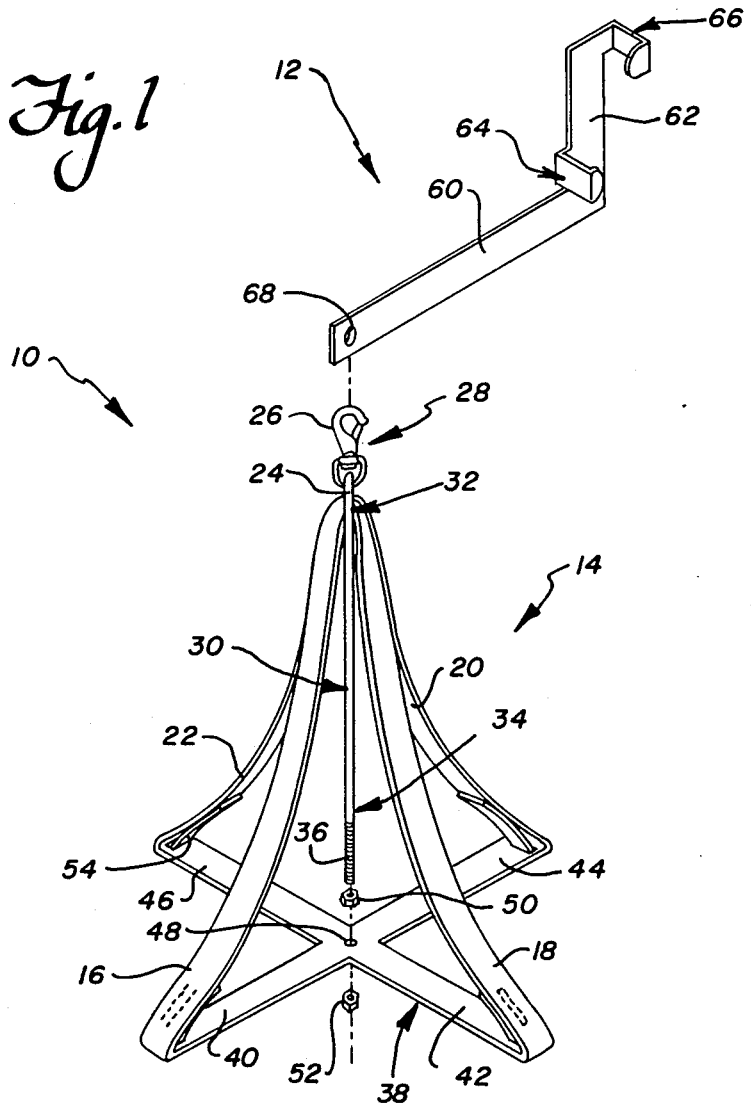
FIG. 1 is a perspective view of the reel according to a first embodiment of the present invention.
Figure 4:
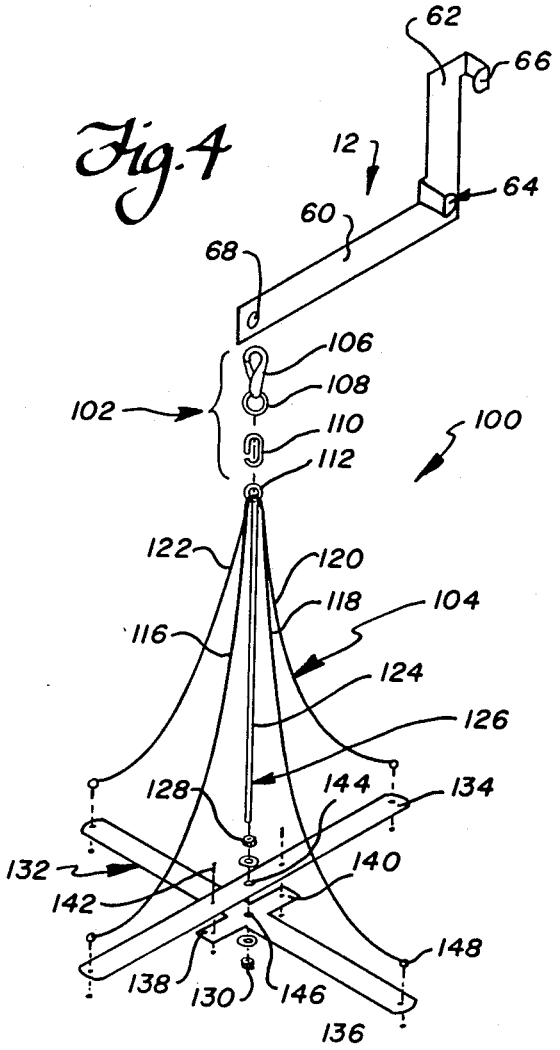
FIG. 4 is a perspective view of a second embodiment attached to a wall stud.
Figure 6:
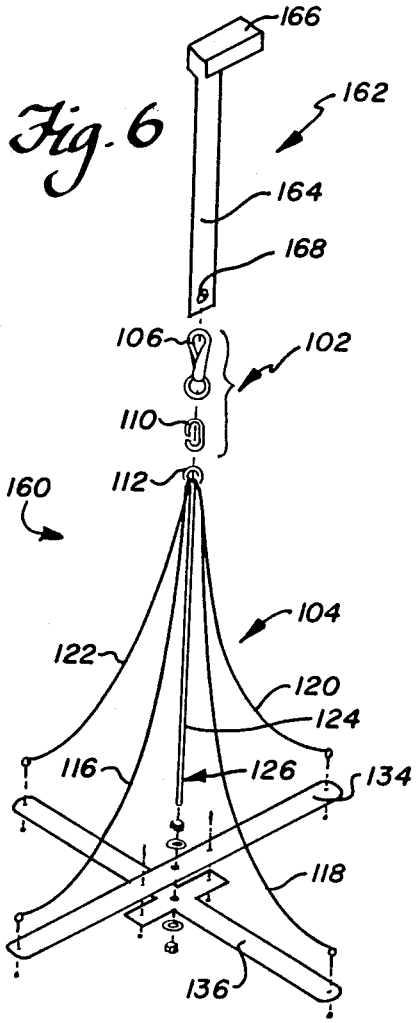
FIG. 6 is a perspective view of the second embodiment supported by a rafter.

FIG. 1 shows the wire dispensing device according to the present invention, generally indicated at 10, which is comprised of a mounting portion 12 and a wire coil support or reel assembly 14. Reel assembly 14 is comprised of four flexible coil support lines or members 16, 18, 20 and 22 whose upper ends converge and either pass through or are connected to a ring 24 which together with a clip fastener 26 form a swivel connector 28. Reel assembly 14 also includes a centrally positioned rod 30 whose top end 32 is connected, such as by welding, to ring 24 and whose bottom end 34 is threaded for at least a portion of its length as represented at 36. Reel assembly 14 also includes a bottom spanner member 38, preferably formed as a one piece member as shown in FIG. 1. However, this bottom member could be formed from a pair of overlapped members such as shown in FIGS. 4 and 6. Spanner 38 includes four arms 40, 42, 44 and 46 and an aperture 48 in the center thereof to receive the threaded portion 36 of rod 30 there through. The vertical position of rod 30 relative to spanner 38 and ring 24 is adjustable by nuts 50 and 52.

The flexible coil support members 16–22 are preferably comprised of two one piece lengths with the portions 16 and 20 forming one member while portions 18 and 22 form the other. As shown in FIG. 1, each of the outer ends of the spanner arms 4046 is provided with a slot type opening, for example as indicated at 54 in FIG. 1 at the end of arm 46. The flexible members are shown in form of two, one piece lengths of webbing or straps with one end of each being passed through a slot 54 on one end of arms 40 and 46 and then back over on itself and stitched or otherwise secured to the remainder of the member. Each length then passes up and through ring 24 and down to the opposite spanner arm 44 and 42, respectively, where the other end is fixed in the slots at the ends of those arms in the same manner as the first end. With the four ends in place on the spanner 30, the threaded portion 36 of rod 30 can then be appropriately positioned within aperture 48 and the lengths of the coil support members extending between ring 24 and spanner 38 can be adjusted. Thus, the supports for the coil can be appropriately tensioned.

Alternatively, the four flexible support members could be separate members extending only between ring 24 and the outer ends of spanner 38, with their respective ends being appropriately fixed to each.

Reel assembly 14 is suspended from a mounting device 12 comprised of a horizontal arm 60 and a vertical arm 62 integrally connected thereto. A rearwardly directed U-shaped member 64 is positioned or formed approximately at the juncture of the horizontal arm 60 and the vertical arm 62 and a forwardly directed U-shaped member 66 positioned or formed at the top of vertical arm 62. The two U-shaped members 64 and 66 are positioned and sized so that together they will straddle a two-by-four or similar structure in the manner shown in FIGS. 2 and 3. The forward or front end of arm 60 also includes an aperture 68 into which clip 26 can be secured. The mounting device 12 is preferably formed by a stamping process to form the necessary blank with the U-shaped members 64 and 66 being subsequently formed by bending. However, mounting device 12 could also be molded, for example, from metal, such as aluminum, or a plastic material so long as it is suitably rigid to resist the loads applied by the reel assembly 14 and a coil mounted thereon.

The exact nature of the flexible support members 16–22 can vary between a wide variety of materials. For example, they could be comprised of synthetic woven structures, such as woven nylon or polyester webs, or blends of various synthetic yarns or fibers, even various types of stiff or solid materials, including solid synthetics such as nylons or other plastics or metal bands or wires. Further, the support members could even have some degree of elasticity and be comprised of various rubbers or elastomeric materials, or various synthetic materials that would provide some resiliency. The flexible support members could also be comprised of a single web or length of material or, alternatively, formed from a plurality of entwined or multistranded structures.

The flexible support members 16–22 thus define a generally conically shaped structure on which coils of wire, even coils or wire having different internal diameters, can be placed and supported in a balanced and uniform way. If one wished to change either the degree of slack between the top of the conically shaped structure defined by the support members and the bottom spanner 38, the height of rod 30 can be adjusted to place varying amounts of more or less tension in members 16–22. It should also be understood that where members 16–22 are formed from an elastic material, the thickness of the members along their lengths from the top portion adjacent ring 24 to the bottom ends adjacent bottom spanner 38 can have varying or different thicknesses along the length thereof thereby varying the degree of elasticity and/or support capability of each member and of the reel.

Figure 2:
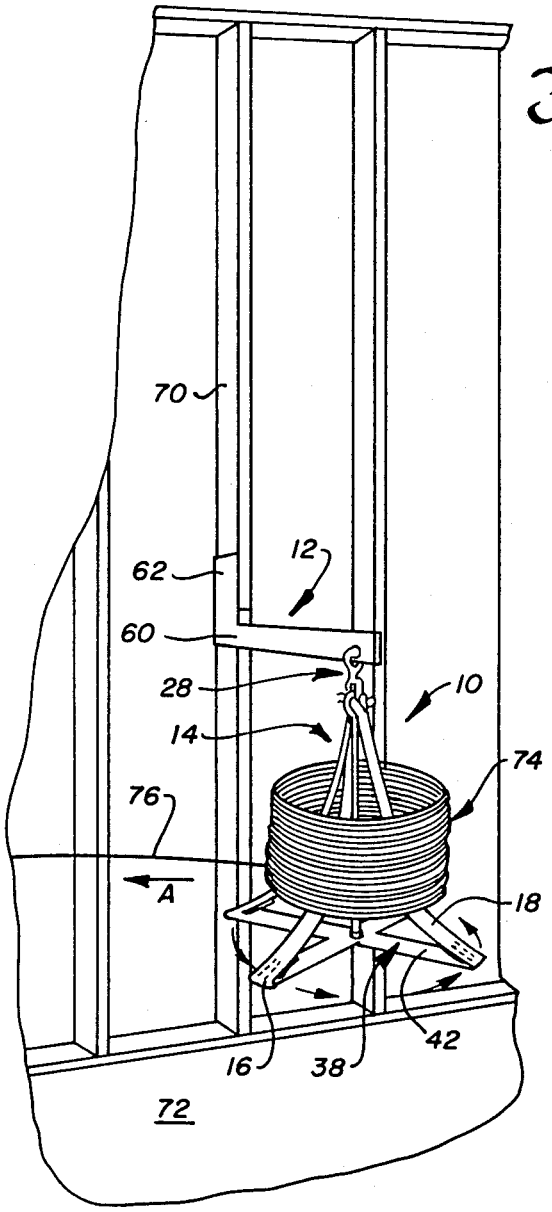
FIG. 2 is a view of the reel shown in FIG. 1 with wire being pulled off the reel.
Figure 3:
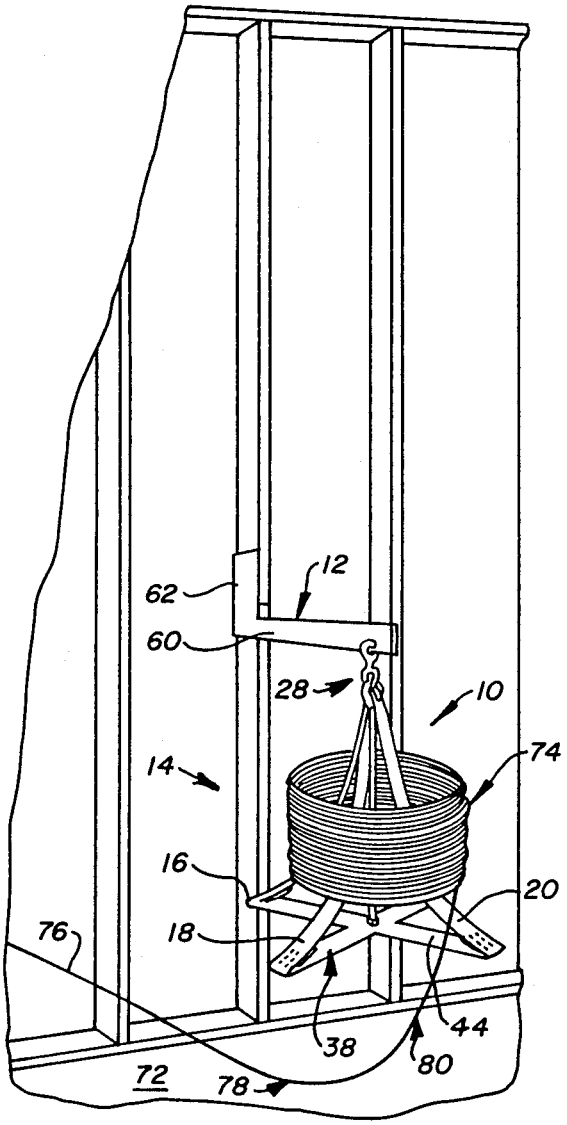
FIG. 3 is a view of the reel shown in FIG.. 1 where pulling of wire has stopped and the reel has been braked.

With reference now to FIGS. 2 and 3, the dispensing device is shown as being supported by its mounting structure 12 from stud 70. As noted in FIG. 2, the bottom of the dispensing device 10 is located a suitable distance above the floor 72 and a coil of wire 74 is supported by the device in a balanced and stable condition. The coil is also equally supported by each of the support members 16–22. Where elastic flexible members are used the load applied by the coil is also more equally applied. In instances where the pulling force is initially strong or quickly applied, the load associated with the coil is less likely to shift and the coil remains more balanced on the reel.

With reference still to FIG. 2, a wire strand 76 is shown being pulled off the coil, from right to left, with the force being applied tangentially to the dispensing device shown by arrow A. It will be noted that the bottom of the coil 74 lies above the bottom spanner 38 and is supported only by the support members. The coil is equally supported by each of the flexible support members 16–22. With the coil positioned in this manner, wire 76 will not only be able to be pulled smoothly from the coil but the pulling force can be applied from any direction. Reel assembly 14 will rotate in a clockwise direction assuming the force is applied as indicated by arrow A. Wire 76 can thus be pulled off of coil 74 at a very steady rate and in a nice even non-kinked manner.

With reference now to FIG. 3, the tangential pulling force has been stopped. The initial continued rotation of coil 74 has allowed a slack area 78 to develop in wire 76 and wire 76 in fact is shown touching floor 72. In addition, there is a portion of wire 76, indicated at 80, that hangs down from coil 74. This portion has been hit or contacted by either or both the flexible member 20 and leg 44 of the bottom spanner 38. The weight of wire 76, including the weight of the slack portion 78 and depending portion 80, together with the increasing force the reel assembly will place on the wire will be sufficient to stop further clockwise rotation of the reel assembly quite abruptly. Accordingly, as soon as pulling tension on wire 76 stops continued rotation of coil 74 will play off a relatively small amount of wire, generally not more than a quarter or a half a rotation of the coil before reel assembly 14 comes to a stop as it engages wire 76. Wire 76 will only be engaged by one of the four outstanding support/spanner arm projections. Consequently, as soon as an electrician or operator wishes to unreel wire 76 from coil 74 the initial renewed pulling force on wire 76 will remove slack area 76. This eliminates engagement of the reel assembly 14 from the wire and further rotation and unwinding of wire 76 can proceed in an unimpeded manner.

Turning our attention now to FIGS. 4–7, the unreeling device now generally indicated at 100, includes a mounting device 42 that is the same as that shown previously in FIG. 1. The swivel connection is generally indicated at 102 and the reel or coil holder is generally indicated at 104. The swivel connection is comprised of an upper swivel portion 106, including a removable clip that can be used with aperture 68 of the mounting device, a bottom ring 108, an intermediate connector 110 and a mounting ring 112 for mounting the reel or cable holder 104 to swivel 102. The coil holder 104 again includes four flexible support members 116, 118, 120, and 122 and a central support rod 124 one end of which is welded or otherwise fixed to ring 112. The lower portion of rod 124 is also threaded as shown at 126 and capable of receiving nuts 128 and 130. A bottom support or spanner, generally indicated at 132, is comprised of two crosspieces 134 and 136 with element 134 being essentially a straight strap having a uniform width from one end to the other whereas element 136 includes two lateral projections 138 and 140 that extend outwardly from the central portion to underlie and be connected to element 134 such as by bolts 142. Elements 134 and 136 also include a centrally positioned aperture 144 and 146, respectively, for receiving the threaded end of rod 126. The flexible supports in the form of bands, straps or wires, as discussed above are individually connected, at the upper end of rod 124, to ring 112 by any convenient means depending upon their particular nature. The other ends can be fastened to elements 136 and 134 by any convenient means such as, for example, eyebolts 148, one of which is provided at the outer ends of each of the elements 134 and 136.

The tension or amount of slack provided in each of the support members 116–122 is still adjustable by means of vertically raising and lowering rod 124 relative to elements 134 and 136 by adjusting the position of nuts 128 and 130 along the threaded lower portion 126. Depending upon the nature and internal dimensions of the coils of wire to be supported, the exact positioning of rod 124 can easily be altered relative to the bottom spanner assembly 132.

Figure 5:
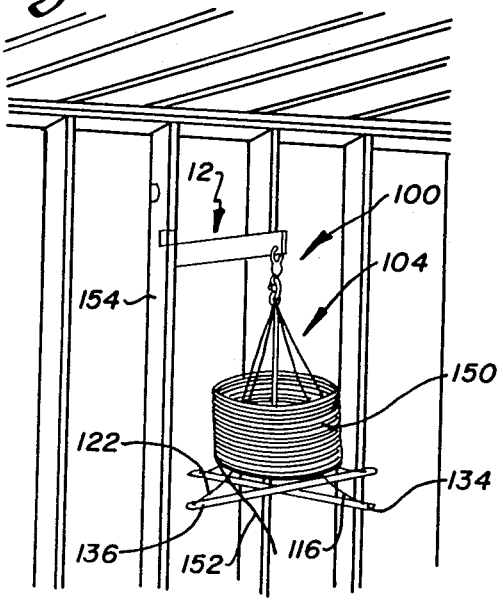
FIG. 5 shows the reel in FIG. 4 braked.

With reference to FIG. 5, a coil of wire is shown at 150. No wire is being drawn in the FIG. and the wire, specifically identified at 152, is shown in a slack condition. The reel holder 104 is supported by mounting device 12 from stud 154. The outwardly extending portion of element 136 in the bottom spanner and support member 122 are in contact with the depending portion of wire 152 and the dispenser is stopped or braked.

Figure 7:
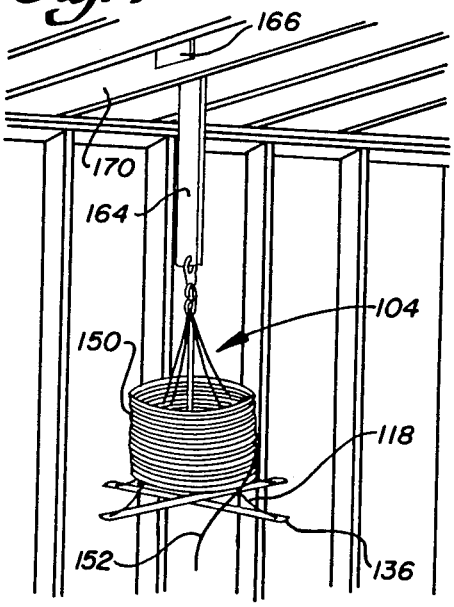
FIG. 7 shows the reel in FIG. 6 braked.

With reference to FIG. 6, the dispenser 160 includes the same lower reel holding portion 104 and the same swivel connection 102 as described in the FIG. 4 embodiment. The mounting device has been modified and is generally indicated at 162; it is comprised of a vertically extending member 164, the upper portion having been formed into a downwardly directed Ushaped member 166 The bottom end of the vertical member 164 includes an aperture 168 to receive hook 106. As shown in FIG. 7, the downwardly directed U-shaped member or channel 166 can be used to grip a joist or rafter 170 to position the reel holder 104 at a desired height above the floor. The coil 150 will continue to be properly and correctly balanced and is also shown in its stopped or braked condition with wire 152 intersecting element 136 and support member 118.

The present invention provides a very stable way of supporting and allowing the dispensing of wire and cable from relatively large or small diameter reels in a manner that supports the cable in a balanced condition. The reel holder also supports a coil in a way that prohibits or minimizes bouncing or side-to-side movements of the coil during unwinding. The present invention will maintain a very stable platform for a coil during unwinding, while simultaneously providing a coil holder that automatically adjusts to the internal diameter of that specific wire coil. Further, this unique structure includes a very precise and positive yet simple stopping mechanism that relies upon the unreeled wire to effectively brake rotation thus assuring that no more than a small amount of wire will be played off the coil once pull on the wire stops.

While the invention has been described in connection with what is presently considered to be the most practical and preferred embodiment, it is to be understood that the invention is not to be limited to the disclosed embodiment, but on the contrary, is intended to cover various modifications are equivalent arrangements included within the spirit and scope of the appended claims.

I claim:

1. A device for holding and permitting the unwinding of coiled material comprising:

means defining a generally conically shaped mandrel or supporting a coil of material in a balanced attitude;

said mandrel means including a plurality of flexible support members each having bottom and top ends;

means for spreading apart the bottom ends of the flexible support members;

means for joining the upper ends of said flexible support members together;

means for adjusting the tension of said flexible support members so that the desired degree of slack is established therein prior to receiving the coil of material and for establishing the desired support of the coil following placement of the coil on said device;

said device further including support means for supporting the device; and means for rotatably connecting said mandrel to said support means.

2. A device as in claim 1 wherein said spreading means extends outwardly beyond the outer boundary of the coiled material.

3. A device as in claim 1 wherein said adjusting means is incrementally adjustable.

4. A device according to claim 1 wherein said spreading means connects the opposing lower bottom ends of said flexible support members together said spreading means further including means defining an aperture in the center thereof.

5. A device according to claim 4 wherein said adjusting means comprises a rod extending between said spreading means and said joining means, wherein at least the bottom portion of said rod is threaded and extends through said aperture means.

6. A device as in claim 1 wherein said spreading means is an integral one piece structure.

7. A device as in claim 1 wherein said spreading means is comprised of two separate crossing members attached together.

8. A device as in claim 1 wherein said flexible support members are elastic.

9. A device as in claim 1 wherein said flexible support members comprise bands.

10. A device as in claim 9 wherein said bands are comprised of a synthetic material.

11. A device as in claim 10 wherein said synthetic material is a plastic material.

* * * * *